US007979926B1

(12) United States Patent
Boegler

(10) Patent No.: US 7,979,926 B1
(45) Date of Patent: Jul. 19, 2011

(54) COLLAPSIBLE OUTDOOR SHOWER KIT

(76) Inventor: David A. Boegler, Bourne, MA (US)

( * ) Notice: Subject to any disclaimer, the term of this patent is extended or adjusted under 35 U.S.C. 154(b) by 329 days.

(21) Appl. No.: 12/283,999

(22) Filed: Sep. 17, 2008

(51) Int. Cl.
*A47K 3/32* (2006.01)

(52) U.S. Cl. ..... 4/599; 4/600; 4/612; 4/614; 4/602; 4/603; 52/264

(58) Field of Classification Search ..... 4/599, 600, 4/612, 614, 602, 603, 416; 222/92; 135/143; 52/264, 263, 79.1, 63.1, 36.4; 248/214
See application file for complete search history.

(56) References Cited

U.S. PATENT DOCUMENTS

| | | | | | |
|---|---|---|---|---|---|
| 117,721 | A | * | 8/1871 | Bain | 52/282.5 |
| 1,566,387 | A | | 12/1925 | Fifield | |
| 1,750,284 | A | * | 3/1930 | Rusatz | 160/88 |
| 1,990,871 | A | * | 2/1935 | Klocke | 4/600 |
| 3,646,590 | A | * | 2/1972 | Bolt | 4/600 |
| 3,657,746 | A | | 4/1972 | Downey | |
| 3,709,237 | A | * | 1/1973 | Smith | 135/87 |
| 4,037,385 | A | * | 7/1977 | Wahlquist | 52/745.02 |
| 4,064,570 | A | * | 12/1977 | Kim | 4/600 |
| 4,413,363 | A | | 11/1983 | Troiano | |
| 4,706,551 | A | * | 11/1987 | Schofield | 454/66 |
| 4,866,794 | A | | 9/1989 | Davies | |
| 5,205,001 | A | | 4/1993 | O'Connell | |
| 5,216,763 | A | | 6/1993 | Grenier | |
| 5,315,721 | A | | 5/1994 | Okun | |
| 5,790,992 | A | | 8/1998 | Ray | |
| D444,215 | S | | 6/2001 | Schanz et al. | |
| 6,389,617 | B1 | | 5/2002 | Hartline et al. | |

* cited by examiner

*Primary Examiner* — Gregory L Huson
*Assistant Examiner* — Lauren Heitzer
(74) *Attorney, Agent, or Firm* — Montgomery Patent and Design; Robert C. Montgomery

(57) ABSTRACT

A collapsible outdoor shower enclosure that folds up nearly flat to a wall surface when not in use is herein disclosed. The shower enclosure is intended for use in outdoor locations where a general floor drain or similar means exists for removal of waste water. The enclosure comprises a right wall assembly and a left wall assembly that have hinged connections allowing for the shower enclosure to fold up against the wall surface. The wall surface would also be the one containing a shower head and shower controls as well. When in a retracted orientation, the enclosure protrudes approximately thirteen (13) inches from the stationary wall surface. During use, each of the wall assemblies fold out ninety degrees (90°) from the wall surface and include a right door and a left door that form an entrance side for a user to enter the shower enclosure. The wall assemblies are provided with corner supports which pin to a ground surface, vertical anchor members which secure the enclosure to the wall surface, and horizontal anchor members which secure the enclosure to the ground surface. When in an extended orientation, the shower enclosure forms a chamber approximately thirty-six (36) inches square thereby allowing the user an area to shower privately therein. When the user is finished using the shower enclosure, it is simply rinsed off and stowed back against the wall surface until the next usage.

17 Claims, 9 Drawing Sheets

COLLAPSIBLE OUTDOOR SHOWER KIT

FIELD OF THE INVENTION

The present invention relates generally to a collapsible outdoor shower enclosure and, more specifically, to said shower enclosure comprising a right wall assembly, a left wall assembly, a right door, and a left door having a plurality of hinged connections that allow the shower enclosure to collapse to a nearly flat configuration in a retracted orientation and to form a chamber, thereby allowing a user an area to shower privately therein when the shower enclosure is in an extended orientation.

BACKGROUND OF THE INVENTION

Camping, hunting and other outdoor activities are among today's most popular leisure activities. The people who enjoy these activities possess a variety of devices that are intended to provide many of the conveniences that they have become accustomed to at home. Portable stoves, inflatable mattresses, and even portable generators that make available a variety of appliances are among the devices commonly found at campsites across the nation. However, showering facilities are somewhat limited in quantity, especially during morning hours at busy shower houses, as the cost to build such dedicated facilities are somewhat high. These same cost factors exist at homes where one may desire an outside shower facility for use with a pool or to clean off after a dirty job before going in the house. Accordingly, there is a need for a means by which one can be provided the convenience of a shower facility at an outdoor location without the cost or dedicated space requirement of a fixed shower. The development of the present invention fulfills this need.

The present invention is a collapsible outdoor shower enclosure that folds up nearly flat to a wall surface when not in use. The shower enclosure is intended for use in outdoor locations where a general floor drain or similar means exists for removal of waste water. The present invention consists of a right wall assembly and a left wall assembly that fold up against the wall surface when in a retracted orientation. The right wall assembly comprises a first right wall, a second right wall, a right header support member, a right vertical anchor member, a right horizontal anchor member, and a right door. Similarly, the left wall assembly includes the same components. The right wall assembly and the left wall assembly have hinged connections allowing for the shower enclosure to fold up against the wall. When the shower enclosure is folded up in the retracted orientation, it protrudes approximately thirteen (13) inches from the stationary wall surface. During use, each of the wall assemblies fold out ninety degrees (90°) from the wall surface and include the right door and left door that form an entrance side for a user to enter the shower enclosure. Furthermore, the wall assemblies are provided with corner supports which pin to a ground surface, vertical anchor members which secure the enclosure to the wall surface, and horizontal anchor members which secure the enclosure to the ground surface. Also, a header is hingedly connected to the right header support member for further stabilizing the shower enclosure. When the shower enclosure is opened in an extended orientation, it forms a chamber area. When the user is finished using the shower enclosure, it is simply rinsed off and stowed back against the wall surface until the next usage. The use of the present invention provides users the ability to quickly and easily take a shower outdoors in a manner which is not only quick and easy but discrete as well. Furthermore, professional contractors frequently build outdoor enclosures such as a shower enclosure from scratch without reference to a set of plans or pre-measured lumber and hardware. The present invention would enable professional contractors to simply purchase one and construct it wherever one would be desired.

Several attempts have been made in the past to provide portable shower units. U.S. Pat. No. 6,389,617, issued to Hartline et al., discloses a portable shower apparatus that is collapsible by grasping a top member and pulling upwards in order to separate the top member from a bottom member thereby extending a shower curtain out to a fully extended position. However, unlike the present invention, the Hartline et al. device does not disclose a shower enclosure comprising wall assemblies hingedly attached to a wall surface thereby allowing the shower enclosure to fold up nearly flat to the wall surface when not in use. Furthermore, the shower curtain of the Harline et al. device fully encloses a user therein, whereas the present invention provides a three (3) sided wall assembly that attaches to the wall surface to provide a four (4) sided open walled enclosure for a user to shower outdoors.

U.S. Pat. No. 5,790,992, issued to Ray, discloses a portable shower comprising a pyramidal frame having four collapsible legs. The Ray shower involves providing a collapsible structure for showering which supports a water bottle adapted to absorb solar energy in a manner that allows for the receiving of sun rays and insulates the water bottle from the surrounding environment to minimize heat loss. However, unlike the present invention, the Ray device does not disclose wall assemblies hingedly connected. Also, as the Ray device concerns absorbing solar energy, it is not in the scope of the present invention.

U.S. Pat. No. 5,315,721, issued to Okun, discloses a collapsible shower stall for creating a shower enclosure that allows alternate use of space when in a collapsed state for inside small bathrooms. However, unlike the present invention, the Okun shower stall is not for use outdoors and does not include hinged wall assemblies that are secured to a wall surface.

U.S. Pat. No. 5,216,763, issued to Grenier, discloses a portable shower apparatus comprising a curtain assembly having a plurality of spaced hollow hoops connected by one or more sets of manifolds. However, unlike the present invention, the Grenier apparatus is not comprised of wall assemblies but instead is comprised of a curtain assembly.

U.S. Pat. No. 5,205,001, issued to O'Connell, discloses a portable shower for invalid use that comprises an expandable shower enclosure which extends vertically and a bottom which is sealingly connected with the shower enclosure to prevent water spillage while a user takes a shower. However, unlike the present invention, the O'Connell shower is to be used indoors and is a four (4) sided shower enclosure.

U.S. Pat. No. 4,866,794, issued to Davies, discloses a portable shower unit constructed of a flexible material that can be suspended from an overhead support by a hook. However, unlike the present invention, the Davies shower has a flexible curtain assembly with a suspension for holding the flexible curtain assembly in a shower enclosure shape.

U.S. Pat. No. 4,413,363, issued to Troiano, discloses a portable shower system that can be disassembled from a position of use to be packed for transportation. However, unlike the present invention the Troiano shower has a plurality of shower ring connectors that connect a shower curtain to a mounting ring.

The prior art appears to disclose a variety of portable shower units. However, none of the prior art particularly describes a collapsible outdoor shower enclosure comprising a right wall assembly and a left wall assembly having a plurality of hinged connections that allow the shower enclosure to collapse to a nearly flat configuration when not in use. Accordingly, there exists a need for a means by which one can be provided the convenience of a shower facility at an outdoor location without the cost or dedicated space requirement of a fixed shower that operates without the disadvantages as described above.

SUMMARY OF THE INVENTION

In view of the foregoing disadvantages inherent in the prior art, it has been observed that there is need for a wall-mounted shower enclosure that folds up nearly flat to the wall when not in use.

An object of the collapsible outdoor shower kit is a durable construction that is capable of withstanding typical outdoor environmental effects, as well as other outward forces.

Another object of the collapsible outdoor shower kit is that it is fabricated of wood, rigid plastic sheets, fiberglass, polycarbonate, or a similar material coated with a waterproof coating.

A further object of the collapsible outdoor shower kit is that it may be introduced in a variety of colors, engravings, and/or designs to appease to the tastes of a variety of users.

Still another object of the collapsible outdoor shower is a shower enclosure that is introduced as a kit comprising anchor sections that are selectively anchored to any type of ground surface.

Still a further object of the collapsible outdoor shower kit is that the enclosure may be secured to a stationary wall instead of or in combination with anchoring in the ground.

Yet a further aspect of the collapsible shower enclosure is that the apparatus, when in extended orientation, forms a chamber area approximately thirty-six (36) inches square.

Still a further object of the collapsible shower enclosure provides for the enclosure to be coated with a waterproof finish, thereby allowing said apparatus to be capable of withstanding typical outdoor environmental effects and other outdoor forces.

Yet still a further object of the collapsible shower enclosure provides for a right and a left door for entrance to the enclosure and to afford privacy to a user.

Yet still another object of the collapsible shower enclosure provides for an enclosure that may be used with a wall surface containing a shower head and a system of shower controls.

Another object of the collapsible shower enclosure provide for wall assemblies that retractably collapse, thereby allowing the enclosure to fold up nearly flat, in a retracted orientation, to a wall surface when not in use.

A further object of the collapsible shower enclosure is that the enclosure may be, in an alternate embodiment, supplied with an integral shower and drain system.

Another object of the collapsible shower enclosure, in an alternate embodiment, provides for a heated water system.

An aspect of the collapsible shower enclosure comprises: a right wall assembly, a door latch and a left wall assembly.

Another aspect of the collapsible shower enclosure comprises a right wall assembly comprising: a first right wall and a second right wall hingedly connected, a right wall header support, a right vertical anchor member, right vertical anchor apertures, a right horizontal anchor member, right horizontal anchor apertures, and a right door hingedly connected to said second right wall. The right vertical anchor apertures provide a means to removably attach the outdoor shower enclosure to a wall surface.

A further aspect of the collapsible shower enclosure comprises a left wall assembly comprising: a first left wall and a second left wall hingedly connected, a left header support member, left vertical anchor members, left vertical apertures, a left horizontal anchor aperture, a plurality of left horizontal anchor apertures, and a left door hingedly connected to the second left wall. The left vertical anchor apertures provide a means to removably attach the outdoor shower enclosure to a wall surface.

Yet a further aspect of the collapsible shower enclosure comprises a door latch providing a means to latch said left door thereto said right door.

Still another aspect of the collapsible shower enclosure comprises right and left vertical anchor members that are removably attached to a wall surface by fastener means trough the right and left vertical anchor apertures. This configuration provides a stabilizing means for said apparatus when said apparatus is in an extended orientation.

Yet another aspect of the collapsible shower enclosure comprises right and left horizontal anchor members that are removably attached to a ground surface by fastener means through the right and left horizontal anchor apertures. This configuration provides a second stabilizing means for said apparatus when said apparatus is in said extended orientation.

Still another aspect of the collapsible shower enclosure comprises a header hingedly connected to the right header support member and a saddle attached to the left header support. This configuration provides a removably attachable securement means to the header. This configuration further provides a third stabilizing means for the enclosure when in the extended orientation.

A further aspect of the collapsible shower enclosure comprises a protruding lip located on an end opposite said right header support member for retaining the header with the saddle.

Yet still a further aspect of the collapsible shower enclosure comprises a right wall pin bracket secured to the second right wall and a left wall pin bracket secured to the second left wall bottom side. The right wall pin engages a ground surface through said right wall pin bracket and the left wall pin engages said ground surface through said left wall pin bracket. This configuration provides additional stabilizing means for the enclosure when in an extended orientation.

Still a further aspect of the collapsible shower enclosure comprises a door lip vertically attached to the right door so that an overhanging portion of said door lip extends beyond the right door and permits the left door second to come into contact with the overhanging portion and provide a closing means to the right and left doors.

A method for using a collapsible outdoor shower enclosure apparatus, said method comprising the steps of gathering and identifying all parts of said apparatus; locating a center point for said apparatus ordinarily therefrom a position of said shower head; measuring and marking eighteen (18) inches outwardly to each side of said shower head; lining said first left wall and said left vertical anchor member therewith previous markings; vertically leveling said first left wall and said left vertical anchor member; marking said left vertical anchor apertures thereon said wall surface and said left horizontal anchor apertures thereon said ground surface; removing said first left wall and said left vertical anchor member therefrom said wall surface; drilling mounting holes which correspond thereto said left vertical anchor apertures and said left horizontal anchor apertures marks; mounting said left vertical anchor member and said left horizontal anchor member by inserting and tightening screws therethrough said left vertical anchor apertures and said left horizontal anchor apertures and therein said wall surface and said ground surface, if said apparatus is being mounted to concrete or masonry, drilling will be performed using a masonry bit and mounting will use screws and anchors; attaching said second left wall thereto said first left wall by lining up a hinge and inserting a hinge pin therein each of said hinges; attaching said left door thereto said second left wall by lining up said hinges and inserting said hinge pins therein said hinges; repeating the above stated steps in a similar manner for mounting said right wall assembly; attaching a header thereto said right header support member by lining up said hinge and inserting said hinge pin therein said hinge; extending said left wall assembly to a fully extended position; marking a location where a left wall pin comes into contact with said ground surface; placing said left wall assembly in a fully retracted orientation; drilling a ground aperture therein said ground surface as marked; repeating the above steps for said ground aperture of said right wall assembly; fully extending said left wall assembly and said right wall assembly; engaging a right wall pin and said left wall pin therein said ground apertures; lifting said header and resting a free end thereon a saddle of said left header support member; entering said chamber of said apparatus through said entrance side; closing said left door and then said right door until a door lip is in contact with said left door; latching said right door and said left door by engaging a hook therein an eyelet; showering as normal; unlatching and opening said right door and said left door; exiting said apparatus; lifting said header therefrom said saddle and placing said header in a hanging rest position; disengaging said right wall pin and said left wall pin therefrom said ground apertures; placing said left wall assembly in a fully retracted orientation; placing said right assembly in a fully retracted orientation; and, benefiting from increased convenience, improved space utilization, and privacy afforded said user of said apparatus.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
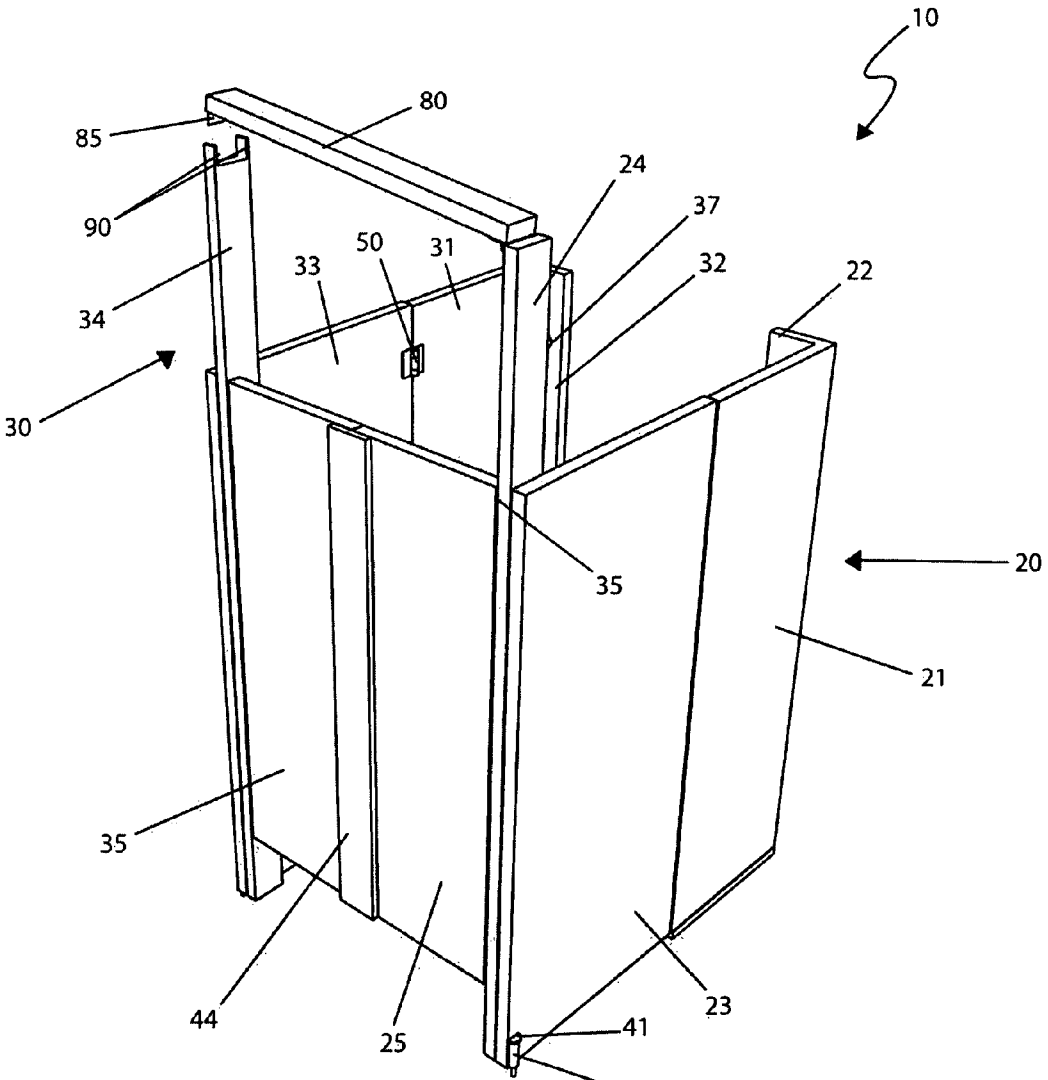
FIG. 1 is a perspective view of a collapsible outdoor shower enclosure 10, according to the preferred embodiment of the present invention.

| | |
|---|---|
| 10 | collapsible outdoor shower enclosure |
| 20 | right wall assembly |
| 21 | first right wall |
| 22 | right vertical anchor member |
| 23 | second right wall |
| 24 | right header support member |
| 25 | right door |
| 26 | right horizontal anchor member |
| 27 | right vertical anchor aperture |
| 28 | right horizontal anchor aperture |
| 30 | left wall assembly |
| 31 | first left wall |
| 32 | left vertical anchor member |
| 33 | second left wall |
| 34 | left header support member |
| 35 | left door |
| 36 | left horizontal anchor member |
| 37 | left vertical anchor aperture |
| 38 | left horizontal anchor aperture |
| 40 | right wall pin bracket |
| 41 | right wall pin |
| 42 | left wall pin bracket |
| 43 | left wall pin |
| 44 | door lip |
| 45 | eyelet |
| 46 | hook |
| 47 | door latch means |
| 50 | hinged connection |
| 51 | hinge |
| 52 | hinge pin |
| 60 | chamber |
| 70 | entrance side |
| 80 | header |
| 85 | protruding lip |
| 90 | saddle |
| 95 | horizontal support member |
| 96 | vertical slat |
| 100 | shower head |
| 110 | wall surface |
| 120 | ground surface |
| 130 | ground aperture |

DETAILED DESCRIPTION OF THE PREFERRED EMBODIMENT

The best mode for carrying out the invention is presented in terms of its preferred embodiment, herein depicted within FIGS. 1 through 8. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that discloses a portable and installable outdoor shower enclosure that may extendably collapsed when not in use. The collapsible outdoor shower enclosure (herein described as the "apparatus") 10 comprises a right wall assembly 20 and a left wall assembly 30 which unfold to form an approximately thirty-six (36) by thirty-six (36) square inch enclosure for showering and also folds up nearly flat thereto a wall surface 110 when not in use. It is envisioned that the apparatus 10 may be fabricated of a plurality of wood, rigid plastic sheets, fiberglass, polycarbonate, or similar material using forming, extrusion, cutting and finishing processes. The materials utilized are envisioned to be coated with a waterproof coating, as well. The materials utilized are envisioned durable, capable of withstanding typical outdoor environmental effects, as well as other outward forces. The apparatus 10 may be introduced in a variety of colors, engravings, and/or designs to appease to the tastes of a variety of users.

Referring now to FIG. 1, a perspective view of the apparatus 10, is disclosed according to the preferred embodiment of the present invention. The right wall assembly 20 and the left wall assembly 30 comprise generally "L"-shaped members each comprising two (2) hinged wall sections. The apparatus 10 is presently illustrated in a fully deployed position creating an approximately thirty six (36) inch by thirty six (36) inch enclosure around a shower head 100. The wall surface 110 provides a source of a water providing means, i.e. the shower head 100. The apparatus 10 also comprises a left door 35 and a right door 25 which are hingedly attached thereto a respective wall assembly 20, 30 via a plurality of hinged connections 50. The apparatus 10 further comprises a door lip 44 which is vertically attached thereto an unhinged outside surface of the right door 25 and has an overhanging portion which comes into contact with an unhinged outside surface of the left door 35 when said doors 25, 35 are in a closed position. The apparatus 10 also comprises a header 80 which is hingedly attached thereto the right wall assembly 20 via a hinged connection 50 and removably attached thereto the left wall assembly 30 and acts as a locking mechanism for said apparatus 10 when in a fully unfolded position. The proximal end of the header 80 comprises two (2) protruding lips 85 designating a male portion that may then be removably received and retained therein the upper left side portion of the left header support member 34 defining a saddle 90. The protruding lips 85 engage the saddle 90 in a crisscross fashion such that the second right wall 23 and the second left wall 33 may not be extended outwardly past the desired point or contracted inwardly past the desired point when in the extended orientation. The header 80 is envisioned to be utilized to stabilize the apparatus 10 in the extended orientation such to resist outward forces, i.e. wind. The header 80 may also be utilized as a means to suspend curtains or the like in combination with or instead of the right door 25 and the left door 35.

The apparatus 10 also comprises a right wall pin 41 and a left wall pin 43 envisioned as a spring pin, a dowel pin, or the like. Each wall pin 41,43 is attached thereto a lower outside surface of the wall assembly 20, 30 via a right wall pin bracket 40 and a left wall pin bracket 42 and is rotatingly and slidingly engaged therein said wall pin bracket 40, 42. Each wall pin 41, 43 engages therethrough a ground aperture 82 comprising approximately a three eights (3/8) inch aperture located thereon a ground surface 120 approximately the distance of the unfolded wall assembly 20, 30 from the wall surface 110 and acts as a locking mechanism for said apparatus 10 when in a fully unfolded position. If desired, stakes may be utilized in conjunction with or instead of the right wall pin 41 and the left wall pin 43 to further anchor the apparatus 10 to the ground surface 120.

Figure 2:
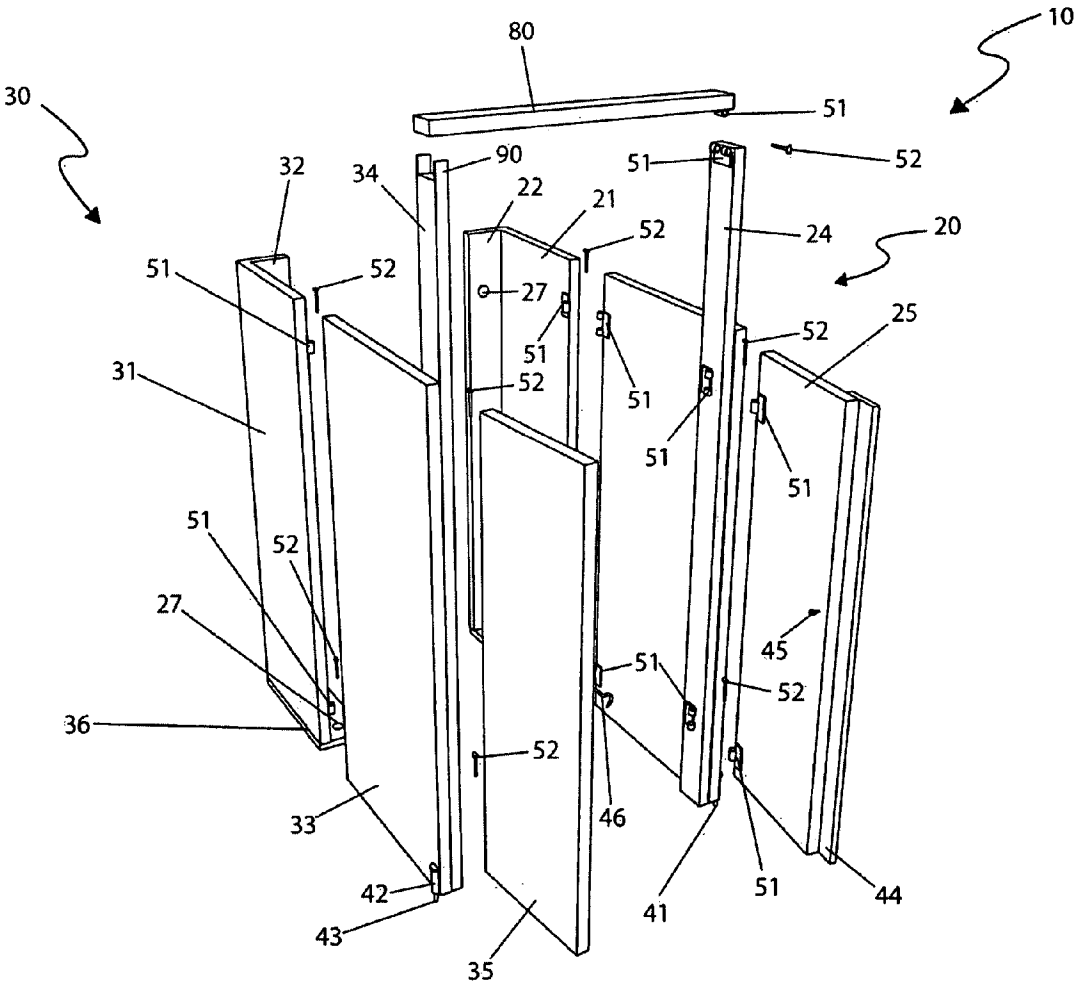
FIG. 2 is an exploded front perspective view of a collapsible outdoor shower enclosure 10, according to a preferred embodiment of the present invention.

Referring now to FIG. 2, an exploded front perspective view of the apparatus 10, according to the preferred embodiment of the present invention, is disclosed. The apparatus 10 is illustrated as separated into component parts as would be assembled by a user. The left wall assembly 30 comprises a first left wall 31, a second left wall 33, a left vertical anchor member 32, a left horizontal anchor member 36, and a left header support member 34. The first left wall 31 comprises a generally "L"-shaped body with said left vertical anchor member 32. A plurality of left vertical anchor apertures 37 are located therethrough the left vertical anchor member 32 which makes contact with the wall surface 110. Also, a plurality of left horizontal anchor apertures 38 are located therethrough the left horizontal anchor member 36 which makes contact with the ground surface 120. The left vertical anchor member 32 is attached thereto the stationary wall surface 110 by engaging screws therethrough the left vertical anchor apertures 37. The second left wall 33 hingedly attaches to the first left wall 31 via two (2) hinges 51 and two (2) hinge pins 52. The second right wall 23 and the second left wall 33 are preferably the same height as with the height of the first right wall 21 and the first left wall 31. The height may be selected as to be at least about as high as the height of the intended user or alternatively be selected as to be just below eye-level of the intended user so that the user may see beyond a chamber 60 formed via the apparatus 10 and the stationary wall surface 110. The left horizontal anchor member 36 is attached thereto the lower underside surface of the first left wall 31 and acts as a means to stabilize and support the left wall assembly 30 by resting thereon the ground surface 120. The left header support member 34 is located thereon an inside surface of the extended end of the second left wall 33 and comprises a corner support portion which extends past the bottom of said second left wall 33 and an upper portion which provides a removably attached housing means thereto the header 80 via a saddle 90. The right wall assembly 20 comprises a first right wall 21, a second right wall 23, a right vertical anchor member 22, and a right horizontal anchor member 26, and a right header support member 24. The right wall assembly 20 uses similar materials and assembly techniques and serves a similar function as the aforementioned left wall assembly 30. The right header support member 24 provides a hingedly attached connection means thereto the header 80 via a hinge 51 and hinge pin 52. The left door 35 comprises a hook 46 and hingedly attaches thereto the second left wall 33 via two (2) hinges 51 and two (2) hinge pins 52. The right door 25 comprises an eyelet 45 and hingedly attaches thereto the second right wall 23 via two (2) hinges 51 and two (2) hinge pins 52. The hook 46 is located on the inside unhinged end of the left door 35 and the eyelet 45 is located on the inside unhinged end of the right door 25 and provide a means for latching said left door 35 thereto said right door 25 when in the closed position. Although the locking fixture is illustrated here as a hook 46 and an eyelet 45 the invention may be introduced with a variety of door latching means 47 such as a slide bolt or the like providing equal benefit to the present invention 10. Once the door latch means 47 has been utilized, that will further secure the relative position of the second right wall 23 and the second left wall 33, as well as the door panels 25, 35, against undesired forces, i.e. wind.

Figure 3A:
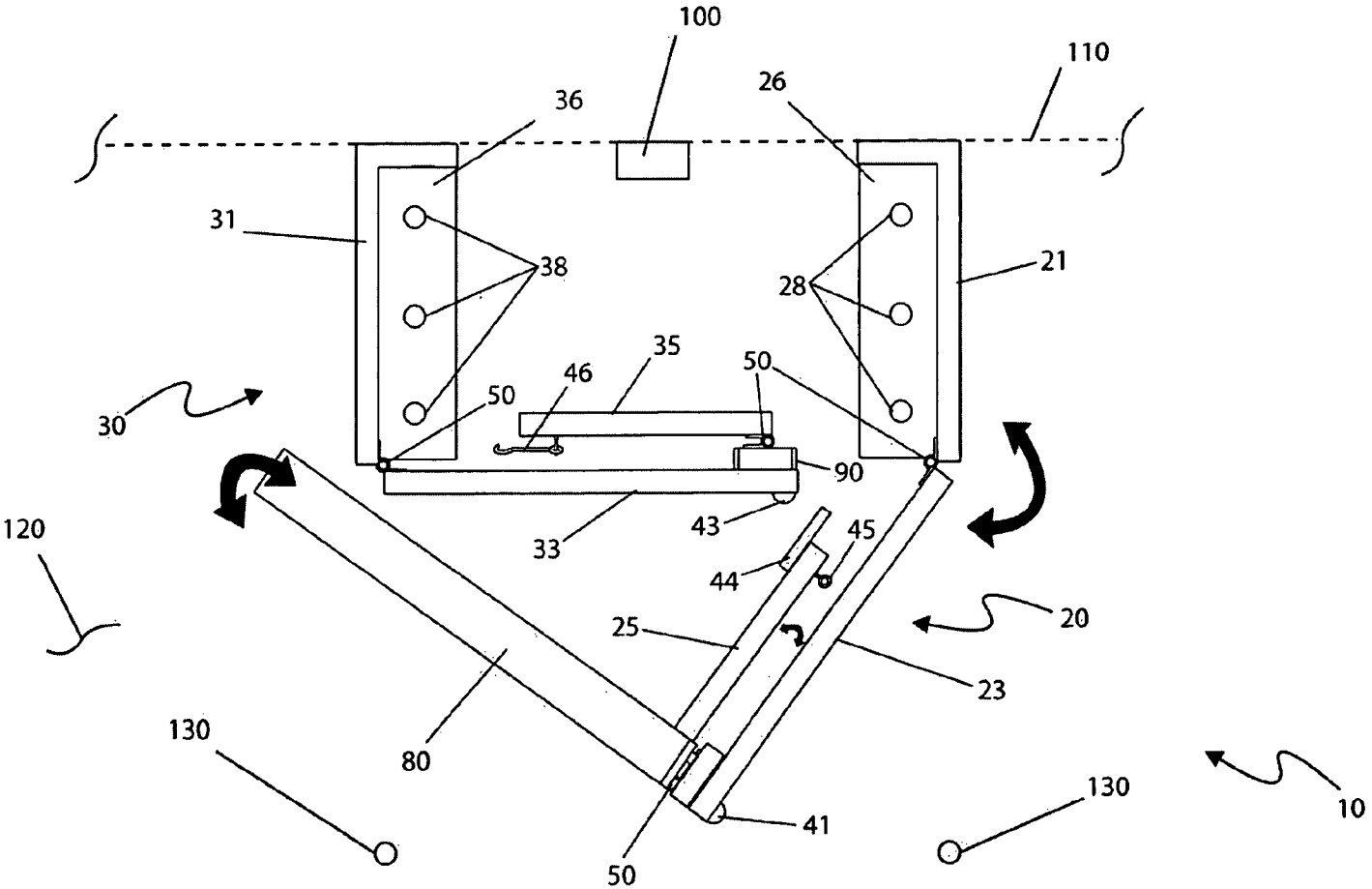
FIG. 3*a* is a top view of a collapsible outdoor shower enclosure 10 in a retracted orientation, depicting a partially collapsed state according to a preferred embodiment of the present invention.
Figure 3B:
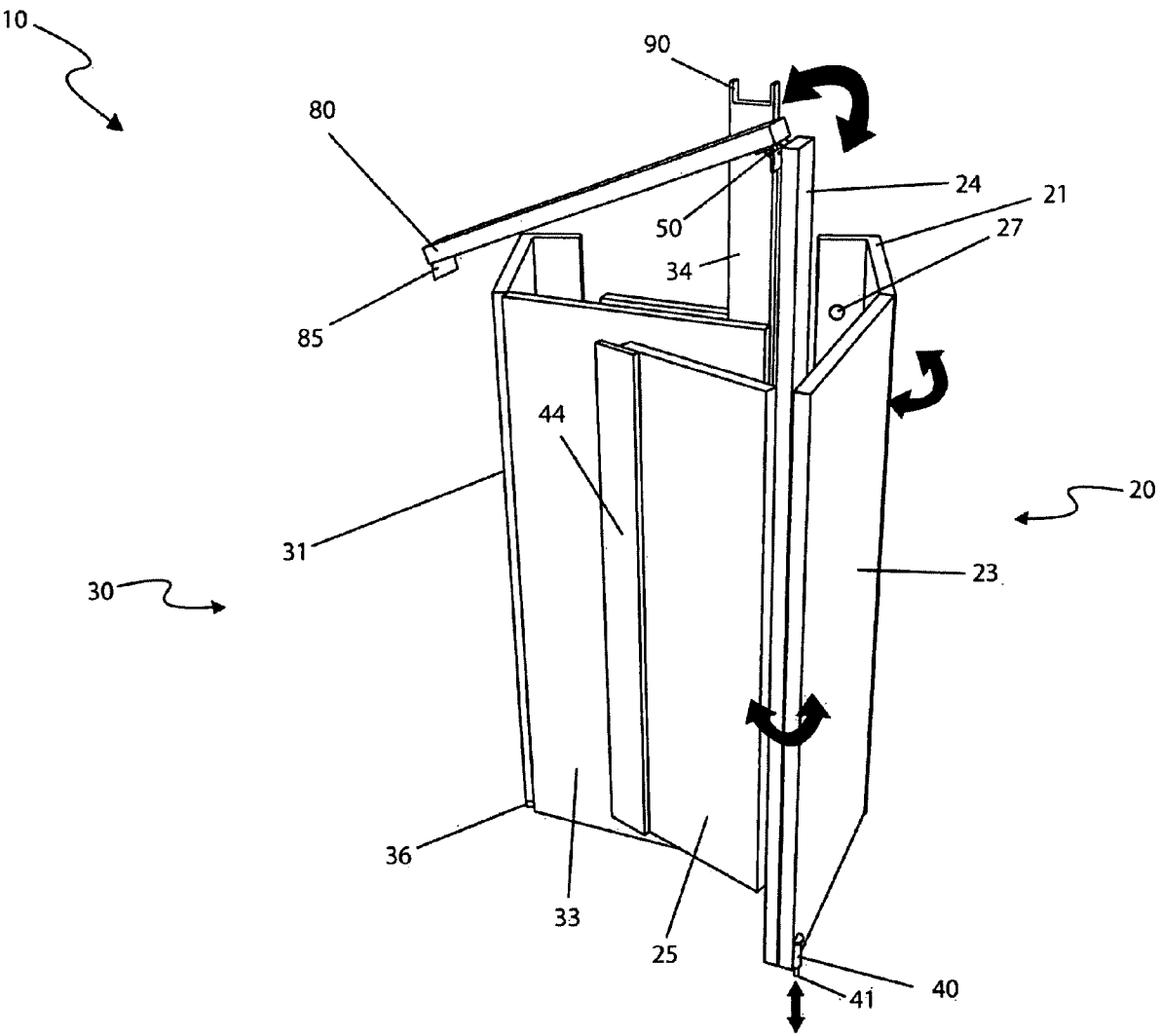
FIG. 3*b* is a perspective view of a collapsible outdoor shower enclosure 10 in a retracted orientation, depicting a partially collapsed state according to a preferred embodiment of the present invention.

Referring now to FIGS. 3*a* and 3*b*, different views depicting the apparatus 10 in a partially collapsed state, according to the preferred embodiment of the present invention, is disclosed. The apparatus 10 is presently illustrated comprising the left wall assembly 30 in a fully retracted orientation and the right wall assembly 20 and the header 80 in a partially collapsed position.

Figure 4:
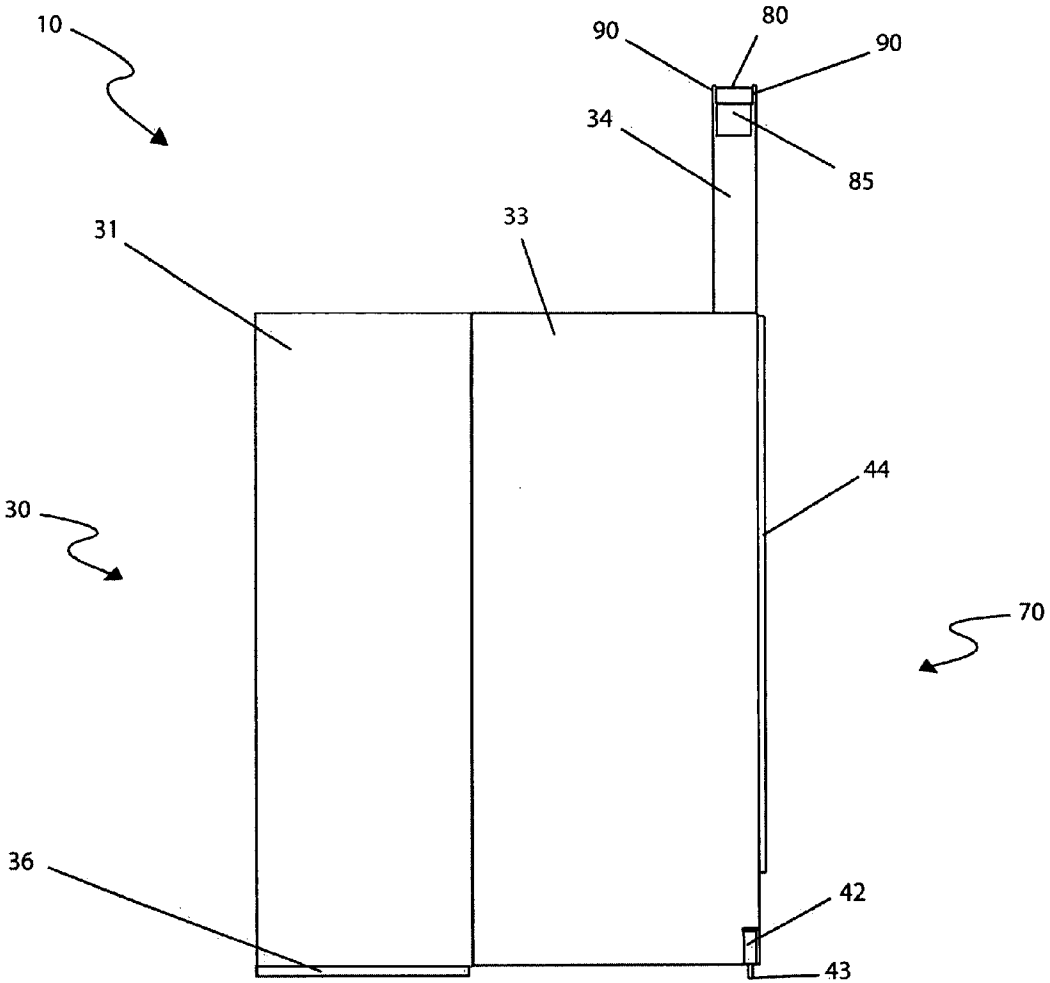
FIG. 4 is a side view of a collapsible outdoor shower enclosure 10 in an extended orientation, according to the preferred embodiment of the present invention.
Figure 5:
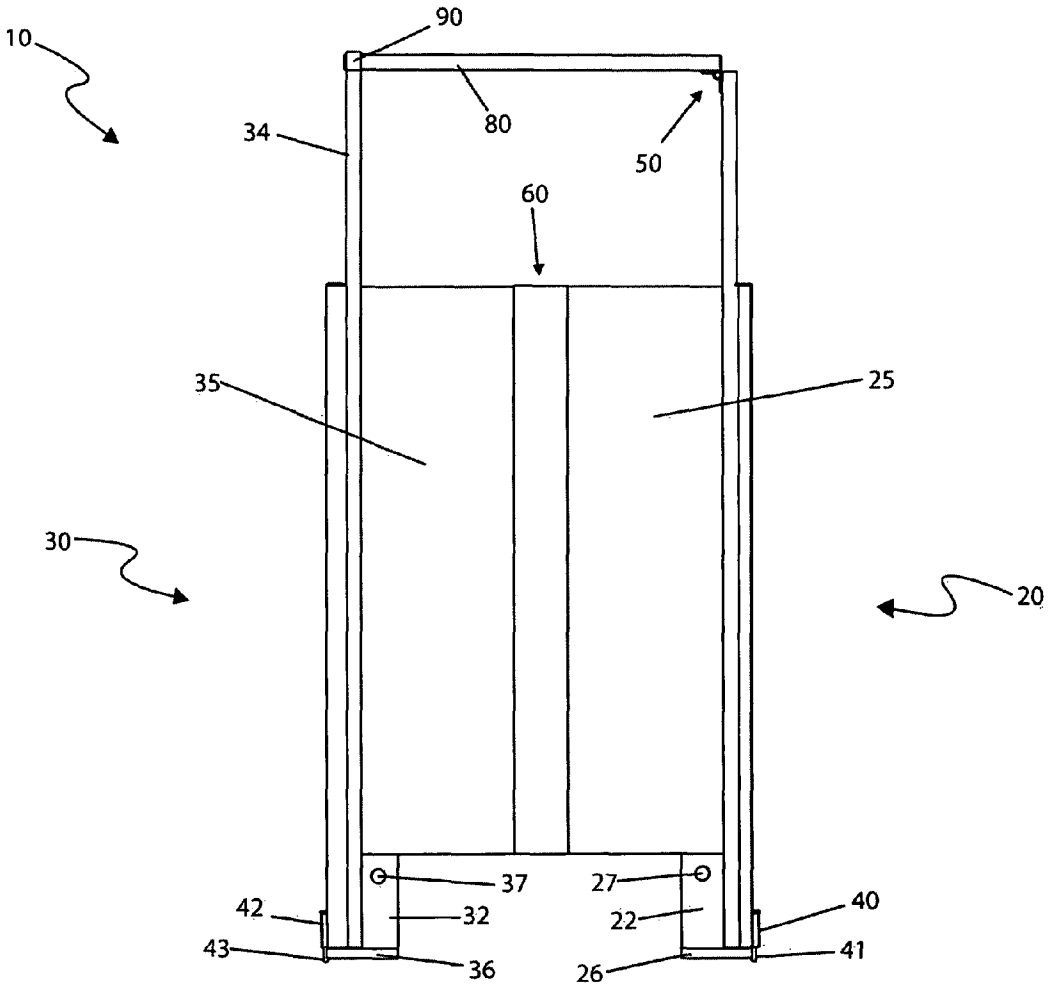
FIG. 5 is a front view of a collapsible outdoor shower enclosure 10 in an extended orientation, according to the preferred embodiment of the present invention.
Figure 6:
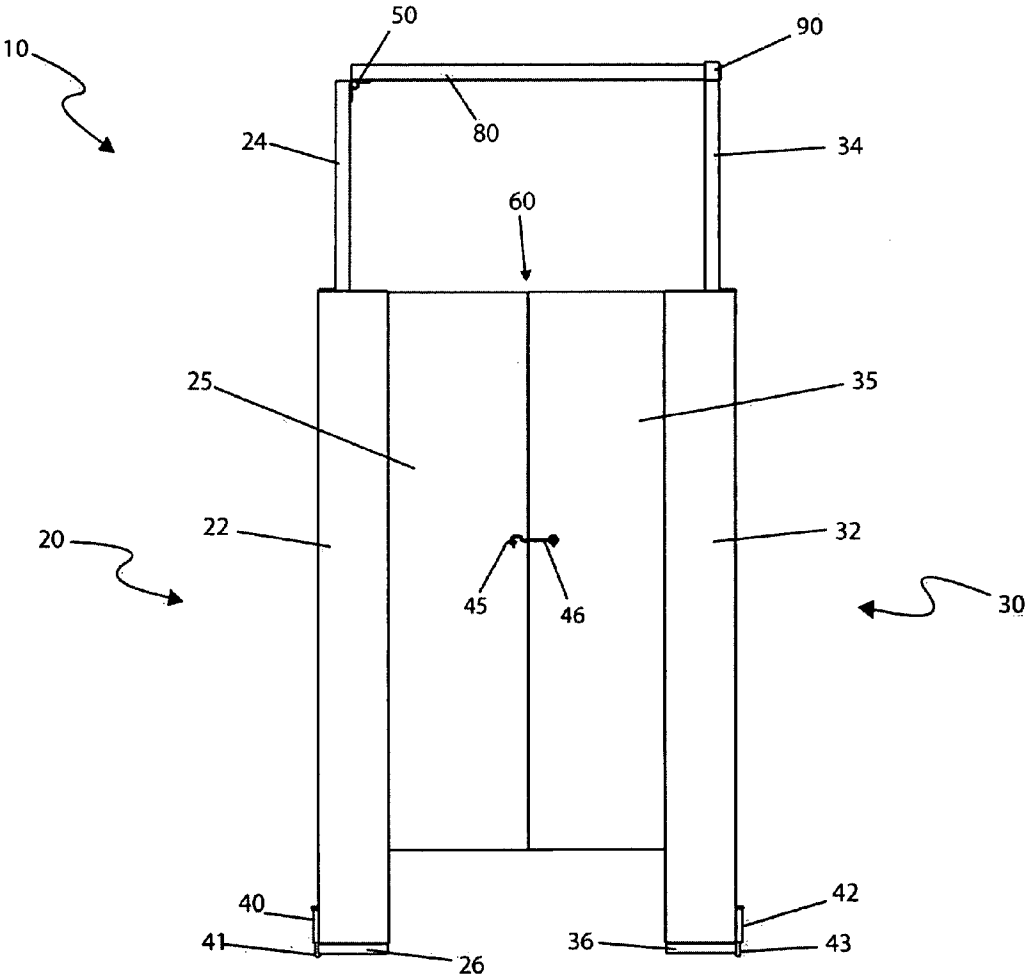
FIG. 6 is a rear view of a collapsible outdoor shower enclosure 10 in an extended orientation, according to the preferred embodiment of the present invention.

Referring now to FIGS. 4, 5, and 6, views of the apparatus 10, are disclosed according to the preferred embodiment of the present invention. Hingedly connected thereto the second right wall 23 is the right door 25 and thereto the second left wall 33 is the left door 35, thereby allowing the right door 25 and the left door 35 to pivot inwardly and/or outwardly, as desired, to provide access therein the chamber 60 formed via the apparatus 10 which will be discussed in greater detail later. The right door 25 and the left door 35 extend away from the second right wall 23 and the second left wall 33 in a perpendicular manner. The right door 25 and the left door 35 are preferably at a smaller height then from the height of the first right wall 21, the first left wall 31, the second right wall 23, and the second left wall 33 so as to permit the user residing therewithin the chamber 60 to view more easily over the door panels 25, 35. The door panels 25, 35 are envisioned to operably open and close the entrance side 70 to provide access therewithin the chamber 60 as well as a means to conceal said entrance side 70.

The second right wall 23 and the right door 25 and the second left wall 33 and the left door 35 are hingedly secured thereto via a series of conventional and pivotal two-way hinges 50 that allows said door panels 25, 35 to swing outwardly and inwardly direction about the longitudinal axis. It is preferred, however not essential, for the door panels 25, 35 to be capable of swinging inwardly and outwardly to give the user the convenience of entering and/or exiting as desired. It is also preferred, however not essential, for the door panels 25, 35 to swing inwardly towards the inward chamber 60 formed via the apparatus 10, such that the inner side of the door panels 25, 35 abuts thereagainst the inner side of the second right wall 23 and the second left wall 33. Thus, the outer surface of the door panels 25, 35 abut thereagainst the stationary wall surface 110 whenever in the collapsed state.

Figure 7:
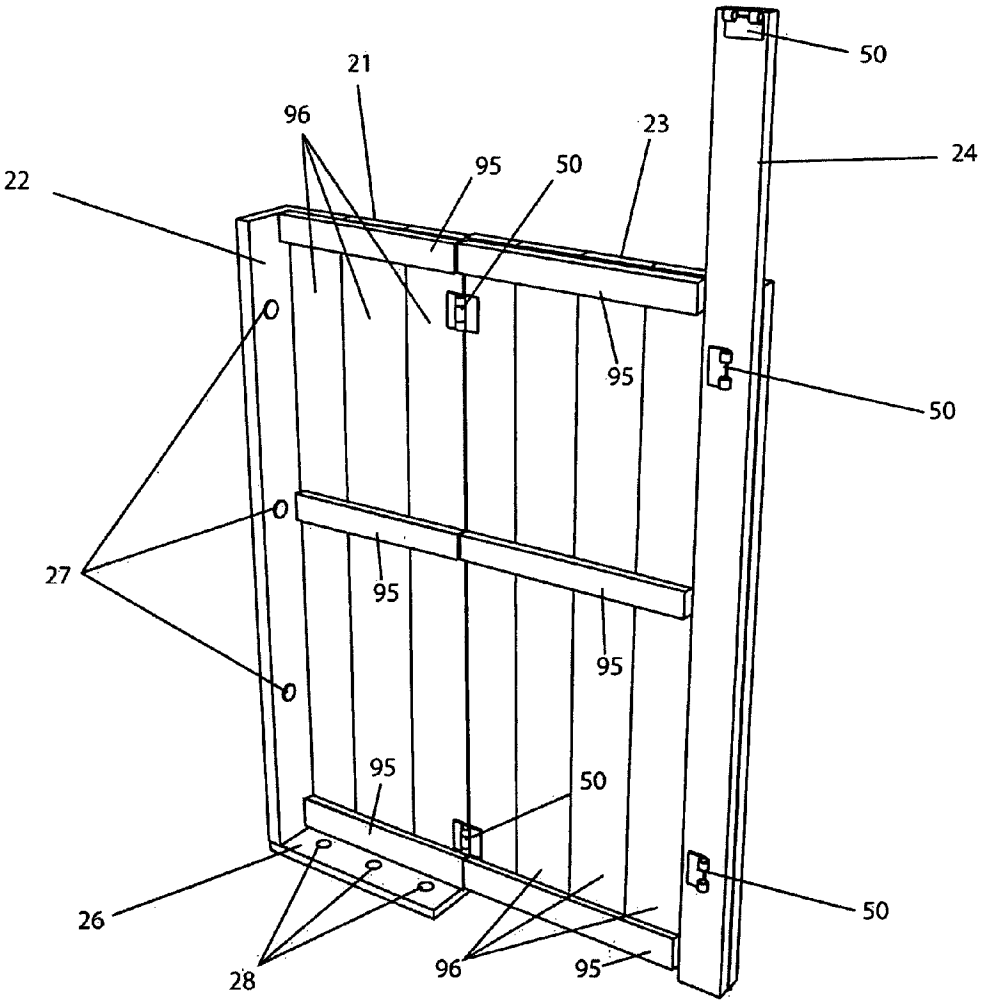
FIG. 7 is a perspective view of a right wall assembly 20 of a collapsible outdoor shower enclosure 10 fabricated of wood, according to a preferred embodiment of the present invention; and, FIG. 8 is a top view of a collapsible outdoor shower enclosure 10 in an extended orientation, according to the preferred embodiment of the present invention.

Referring now to FIG. 7, a side perspective view of the right wall assembly 20, according to the preferred embodiment of the present invention, is disclosed. The right wall assembly 20 is presently illustrated in the fully extended orientation and is shown in a preferred embodiment made of weather treated wood. The right wall assembly 20 comprises a plurality of horizontal support members 95 and a plurality of vertical slats 96. The vertical slats 96 made up the wall surface and the horizontal support members 95 act as a means of support and connection for said vertical slats 96. The left wall assembly 30, the left door 35, and the right door 25 will be constructed with similar materials and in a similar manner as the aforementioned right wall assembly 20. The hinged connections 50 comprise preferably common commercially available hinge parts. Although shown as a preferred embodiment it is understood the present invention 10 may be introduced in a variety of different materials as described above, which may alter the construction in an expected manner while providing equal benefit.

Figure 8:
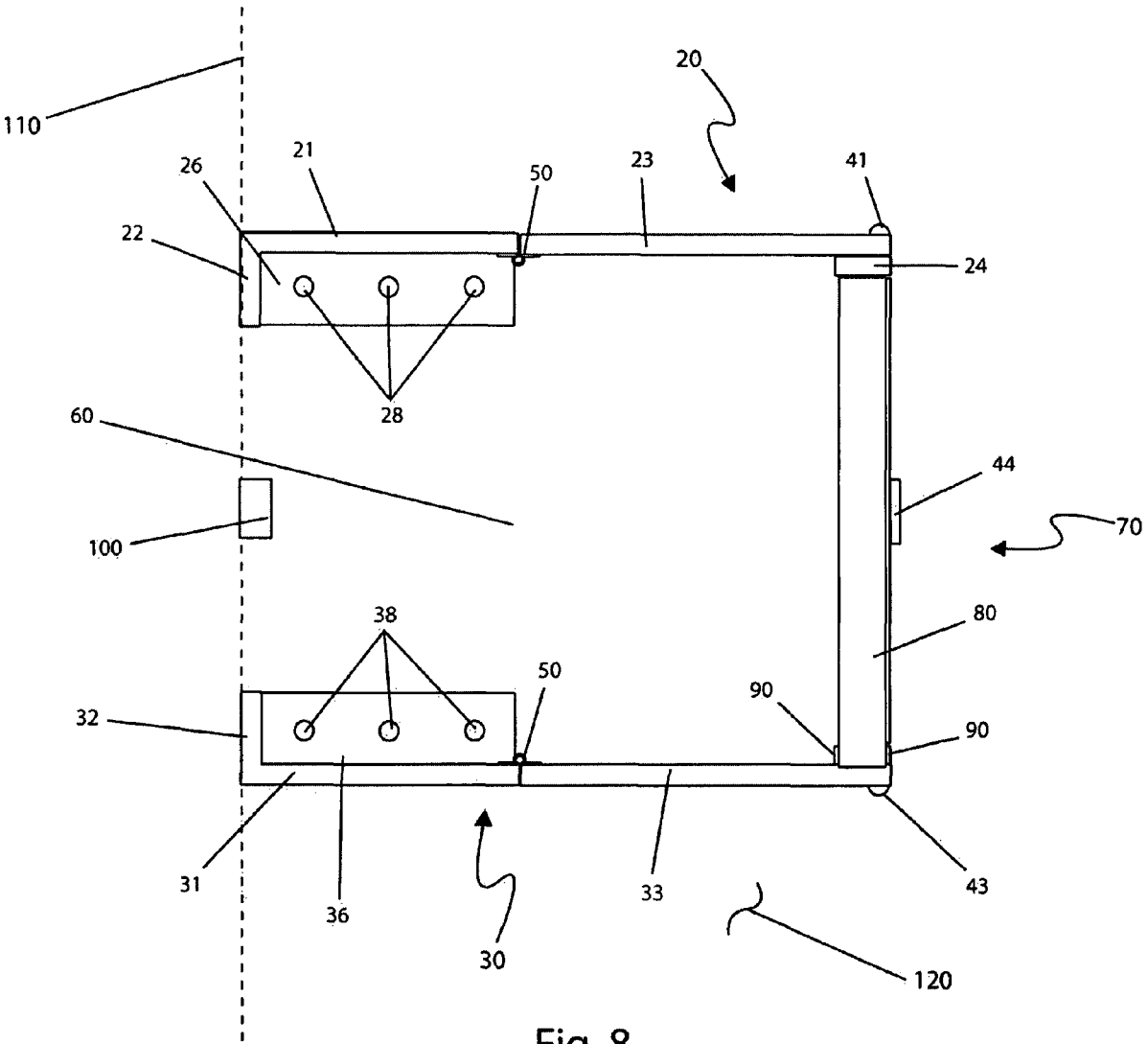

Referring now to FIG. 8, top view of the apparatus 10, is herein disclosed according to the preferred embodiment of the present invention. The apparatus 10 is envisioned to comprise the right wall assembly 20, the left wall assembly 30, the right door 25, and the left door 35 to form a substantially three-sided walled enclosure and discloses one (1) side opened as the entrance side 70 to present a means to gain access thereto a rectangular interior chamber 60 with a sufficient amount of space to contain one (1) or more users of a plurality of sizes. The right wall assembly 20 and the left wall assembly 30 function together to form the chamber 60 therewithin for the user to utilize the chamber area 60 to privately and discretely shower.

The chamber 60 formed therein is a direct result of the dimensions of the apparatus 10 which preferably, but not essentially, provides a sizeable chamber 60 thereby permitting free movement of the users therein for maximum convenience. The entrance side 70 comprises door panels 25, 35 that hingedly swing about the connection axis therebetween said door panels 25, 35 and the second right wall 23 and the second left wall 33. The entrance 70 is dependent upon the height of the right wall assembly 20 and the left wall assembly 30 as well as the combined widths of the door panels 25, 35. However, it is envisioned that the apparatus 10 may designed in a plurality of dimensions such to allow users of all sizes to utilize the apparatus 10.

The apparatus 10 is defined as being a wall-hung shower enclosure that may collapse into a collapsed state nearly flat to the wall at which it is mounted thereagainst, as depicted in FIG. 1. The apparatus 10 is intended for use in outdoor locations whereas a water providing means, i.e. shower head 100 nozzle, and/or a general floor drain or similar means exists. Whenever the apparatus 10 is in the collapsed state, said apparatus 10 protrudes approximately thirteen (13) inches away therefrom the stationary wall surface 110. Whenever so desired, the apparatus 10 may be extended, with the second right wall 23 and the second left wall 33 extending out ninety degrees (90°) therefrom the stationary wall surface 110, and the door panels 25, 35 extending out ninety degrees (90°) therefrom the second walls 23, 33, in a parallel arrangement therewith the stationary wall surface 110. Whenever in the extended orientation, the apparatus 10 forms a shower enclosure with a rectangular chamber 60, as depicted in FIG. 7. When finished, the apparatus 10 is simply rinsed off and stowed back against the wall 110 until the next usage.

An alternate embodiment of the present invention may present a means for the apparatus 10 hold and dispense a supply of water. Such means would require the use of a water storage tank with or without the use of a heating section to selectively heat the water as desired. A drain may also be included within the alternate embodiment of the invention such to collect and allow the user to withdraw the collected water.

The preferred embodiment of the present invention can be utilized by the common user in a simple and effortless manner with little or no training. After initial purchase or acquisition of the apparatus 10, it would be configured as indicated in FIGS. 1 through 8.

The method of utilizing the device may be achieved by performing the following steps: gathering and identifying all the piece parts of the apparatus 10; locating the center point for the shower enclosure 10 ordinarily the shower head 100; measuring and marking eighteen (18) inches outwardly to each side of the shower head 100; lining the first left wall 31 and the left vertical anchor member 32 therewith the previous markings; vertically leveling the first left wall 31 and the left vertical anchor member 32; marking the left vertical anchor apertures 37 thereon the wall surface 110 and the left horizontal anchor apertures 38 thereon the ground surface 120; removing the first left wall 31 and the left vertical anchor member 32 therefrom the wall surface 110; drilling mounting holes which correspond thereto the left vertical anchor apertures 37 and the left horizontal anchor apertures 38 marks; mounting the left vertical anchor member 32 and the left horizontal anchor member 36 by inserting and tightening screws therethrough the left vertical anchor apertures 37 and the left horizontal anchor apertures 38 and therein the wall surface 110 and the ground surface 120, if the apparatus 10 is being mounted to concrete or masonry, drilling will be performed using a masonry bit and mounting will use screws and anchors; attaching the second left wall 33 thereto the first left wall 31 by lining up the hinges 51 and inserting the hinge pins 52 therein each of said hinges 51; attaching the left door 35 thereto the second left wall 33 by lining up the hinges 51 and inserting the hinge pins 52 therein said hinges 51; repeating the above stated steps in a similar manner for mounting the right wall assembly 20; attaching the header 80 thereto the right header support member 24 by lining up the hinge 51 and inserting the hinge pin 52 therein said hinge 51; extending the left wall assembly 30 to a fully extended position; marking the location where the left wall pin 43 comes into contact with the ground surface 120; placing the left wall assembly 30 in a fully retracted orientation; drilling a ground aperture 130 therein the ground surface 120 as marked; repeating the above steps for the ground aperture 130 of the right wall assembly 20; fully extending the left wall assembly 30 and the right wall assembly 20; engaging the right wall pin 41 and the left wall pin 43 therein the ground apertures 130; lifting the header 80 and resting the free end thereon the saddle 90 of the left header support member 34; entering the chamber 60 of the shower assembly 10 through the entrance side 70; closing the left door 35 and then the right door 25 until the door lip 44 is in contact with said left door 35; latching the right door 25 and the left door 35 by engaging the hook 46 therein the eyelet 45; showering as normal; unlatching and opening the right door 25 and the left door 35; exiting the shower assembly 10; lifting the header 80 therefrom the saddle 90 and placing the header 80 in a hanging rest position; disengaging the right wall pin 41 and the left wall pin 43 therefrom the ground apertures 130; placing the left wall assembly 30 in a fully retracted orientation; placing the right assembly 20 in a fully retracted orientation; and, benefiting from increased convenience, improved space utilization, and privacy afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A collapsible outdoor shower enclosure apparatus, comprising:

a right wall assembly wherein said right wall assembly can be collapsed and extended;

a left wall assembly hingedly connected theretogether with said right wall assembly, thereby said left wall assembly can be collapsed and extended;

a right door hingedly connected thereto said right wall assembly;

a left door hingedly connected thereto said left wall assembly;

a header hingedly connected thereto a right header support member;

a saddle attached thereto a left header support member thereby providing a removably attachable securement means therewith said header;

wherein said header provides a first stabilizing means for said apparatus when said apparatus is in said extended orientation;

wherein said header is hingedly connected thereto said right wall assembly and removably secured thereto said left wall assembly, thereby providing a first stabilizing means for said apparatus in an extended orientation;

wherein said right wall assembly and said left wall assembly form a three (3) sided shower enclosure that is removably secured to a wall surface when said apparatus is in said extended orientation;

wherein said right wall assembly and said left wall assembly and said wall surface form a chamber therein when said apparatus is in said extended orientation thereby providing an area for said user to shower privately;

wherein said right door and said left door are removably attached theretogether and provide an entrance side for a user to enter said chamber when said apparatus is in said extended orientation;

wherein said right wall assembly and said left wall assembly are removably attached thereto said wall surface using a wall fastener means, thereby providing a second stabilizing means for said apparatus in said extended orientation;

wherein said right wall assembly and said left wall assembly are removably attached thereto a ground surface using a ground fastener means, thereby providing a third stabilizing means for said apparatus in said extended orientation;

wherein said apparatus is used with said wall surface containing a shower head; and, wherein said right wall assembly and said left wall assembly collapse from said extended orientation to a retracted orientation, thereby allowing said apparatus to fold up when not in use.

2. The apparatus of claim 1, wherein said apparatus further comprises:

a right wall pin bracket secured thereto an outer surface of said right wall assembly; and, a left wall pin bracket secured thereto an outer surface of said left wall assembly;

wherein a right wall pin engages said ground surface therethrough said right wall pin bracket thereby allowing a fourth stabilizing means for said apparatus when in said extended orientation; and, wherein a left wall pin engages said ground surface therethrough said left wall pin bracket thereby allowing a fifth stabilizing means for said apparatus when in said extended orientation.

3. The apparatus of claim 1, wherein said apparatus further comprises a door lip vertically attached thereto an outer surface of said right door such that an overhanging portion of said door lip extends beyond said right door, thereby allowing said left door to come in contact with said overhanging portion and providing a closing means thereto said right door and left door.

4. The apparatus of claim 1, wherein said apparatus is fabricated of one of the following list: wood, plastic sheets, fiberglass, or polycarbonate.

5. The apparatus of claim 1, wherein said apparatus is coated with a waterproof finish, thereby allowing said apparatus to be capable of withstanding typical outdoor environmental effects and other outdoor forces.

6. A collapsible outdoor shower enclosure apparatus, comprising:

a right wall assembly comprising:

a first right wall comprising a first right wall first side, a first right wall second side, a first right wall top side, and a first right wall bottom side;

a second right wall comprising a second right wall first side, a second right wall second side, a second right wall top side, and a second right wall bottom side, said second right wall first side hingedly connected thereto said first right wall first side;

a right header support member secured to said second right wall top side and extending vertically upwards therefrom;

a right vertical anchor member comprising a plurality of right vertical anchor apertures therein secured to said first right wall second side, thereby forming an "L" shape therewith said first right wall and providing a means to removably attach said apparatus thereto a wall surface;

a right horizontal anchor member comprising a plurality of right horizontal anchor apertures therein secured to said first right wall bottom side, thereby providing a means to removably attach said apparatus thereto a ground surface; and, a right door comprising a right door first side and a right door second side, said right door first side hingedly connected thereto said second right wall second side;

a left wall assembly comprising:

a first left wall comprising a first left wall first side, a first left wall second side, a first left wall top side, and a first left wall bottom side;

a second left wall comprising a second left wall first side, a second left wall second side, a second left wall top side, and a second left wall bottom side, said second left wall first side hingedly connected thereto said first left wall first side;

a left header support member secured to said second left wall top side and extending vertically upwards therefrom;

a left vertical anchor member comprising a plurality of left vertical anchor apertures therein secured to said first left wall second side, thereby forming an "L" shape therewith said first left wall and providing a means to removably attach said apparatus thereto said wall surface;

a left horizontal anchor member comprising a plurality of left horizontal anchor apertures therein secured to said first left wall bottom side, thereby providing a means to removably attach said apparatus thereto said ground surface; and, a left door comprising a left door first side and a left door second side, said left door first side hingedly connected thereto said second left wall second side;

a door latch means providing a means to latch said left door thereto said right door;

a header hingedly connected thereto said right header support member; and, a saddle attached thereto said left header support member thereby providing a removably attachable securement means therewith said header;

wherein said header provides a first stabilizing means for said apparatus when said apparatus is in said extended orientation;

wherein said right wall assembly and said left wall assembly form a three (3) sided shower enclosure that is removably secured to said wall surface when said apparatus is in an extended orientation;

wherein said right wall assembly and said left wall assembly and said wall surface form a chamber therein when said apparatus is in said extended orientation, thereby providing an area for said user to shower privately;

wherein said right vertical anchor member and said left vertical anchor member are removably attached thereto said wall surface by engaging a wall fastener means therethrough said plurality of right vertical anchor apertures and said plurality of left vertical anchor apertures, thereby providing a second stabilizing means for said apparatus in an extended orientation;

wherein said right horizontal anchor member and said left horizontal anchor member are removably attached thereto said ground surface by engaging a ground fastener means therethrough said plurality of right horizontal anchor apertures and said plurality of left horizontal anchor apertures thereby providing a third stabilizing means for said apparatus in said extended orientation;

wherein said right door and said left door provide an entrance side for a user to enter said chamber when said apparatus is in said extended orientation;

wherein said apparatus is used with said wall surface containing a shower head; and, wherein said right wall assembly and said left wall assembly collapse from said extended orientation to a retracted orientation, thereby allowing said apparatus to fold up when not in use.

7. The apparatus of claim 6, wherein said header further comprises a protruding lip located on an end opposite said right header support member for retaining said header therewith said saddle.

8. The apparatus of claim 6, wherein said apparatus further comprises:

a right wall pin bracket secured thereto a second right wall outer surface of said second right wall bottom side; and, a left wall pin bracket secured thereto a second left wall outer surface of said second left wall bottom side;

wherein a right wall pin engages said ground surface therethrough said right wall pin bracket thereby allowing a fourth stabilizing means for said apparatus when in said extended orientation; and, wherein a left wall pin engages said ground surface therethrough said left wall pin bracket thereby allowing a fifth stabilizing means for said apparatus when in said extended orientation.

9. The apparatus of claim 6, wherein said apparatus further comprises a door lip vertically attached thereto said right door second side in a manner where an overhanging portion of said door lip extends beyond said right door second side thereby allowing said left door second side to come in contact with said overhanging portion and providing a closing means thereto said right door and left door.

10. The apparatus of claim 6, wherein said apparatus when in said extended orientation forms a chamber area.

11. The apparatus of claim 6, wherein said apparatus when in said retracted orientation protrudes outward approximately thirteen (13) inches from said wall surface.

12. The apparatus of claim 6, wherein said door latch means comprises:

a hook located on a left door inside surface of said left door; and, an eyelet located on a right door inside surface of said right door;

wherein said hook is latched therein said eyelet thereby closing said left door thereto said right door.

13. The apparatus of claim 6, wherein said apparatus is fabricated of one of the following list: wood, plastic sheets, fiberglass, or polycarbonate.

14. The apparatus of claim 6, wherein said apparatus is coated with a waterproof finish, thereby allowing said apparatus to be capable of withstanding typical outdoor environmental effects and other outdoor forces.

15. The apparatus of claim 6, wherein said apparatus is available in a variety of colors, engravings, and designs.

16. The apparatus of claim 6, wherein said apparatus further comprises:

a plurality of vertical slats making up said right wall assembly and said left wall assembly; and, a plurality of horizontal support members thereby providing a means of support and connection for said plurality of vertical slats;

wherein said plurality of vertical slats and said plurality of horizontal support members are comprised of weather treated wood.

17. A method for installing and using a collapsible outdoor shower enclosure apparatus, said method comprising the steps of:

providing said apparatus, comprising:

a right wall assembly comprising:

a first right wall comprising a first right wall first side, a first right wall second side, a first right wall top side, and a first right wall bottom side;

a second right wall comprising a second right wall first side, a second right wall second side, a second right wall top side, and a second right wall bottom side, said second right wall first side hingedly connected thereto said first right wall first side;

a right header support member secured to said second right wall top side and extending vertically upwards therefrom;

a right vertical anchor member comprising a plurality of right vertical anchor apertures therein secured to said first right wall second side, thereby forming an "L" shape therewith said first right wall and providing a means to removably attach said apparatus thereto a wall surface;

a right horizontal anchor member comprising a plurality of right horizontal anchor apertures therein secured to said first right wall bottom side thereby providing a means to removably attach said apparatus thereto a ground surface; and, a right door comprising a right door first side and a right door second side, said right door first side hingedly connected thereto said second right wall second side;

a left wall assembly comprising:

a first left wall comprising a first left wall first side, a first left wall second side, a first left wall top side, and a first left wall bottom side;

a second left wall comprising a second left wall first side, a second left wall second side, a second left wall top side, and a second left wall bottom side, said second left wall first side hingedly connected thereto said first left wall first side;

a left header support member secured to said second left wall top side and extending vertically upwards therefrom;

a left vertical anchor member comprising a plurality of left vertical anchor apertures therein secured to said first left wall second side, thereby forming an "L" shape therewith said first left wall and providing a means to removably attach said apparatus thereto said wall surface;

a left horizontal anchor member comprising a plurality of left horizontal anchor apertures therein secured to said first left wall bottom side thereby providing a means to removably attach said apparatus thereto said ground surface; and, a left door comprising a left door first side and a left door second side, said left door first side hingedly connected thereto said second left wall second side; and, a door latch means providing a means to latch said left door thereto said right door;

wherein said right wall assembly and said left wall assembly form a three (3) sided shower enclosure that is removably secured to said wall surface when said apparatus is in an extended orientation;

wherein said right wall assembly and said left wall assembly and said wall surface form a chamber therein when said apparatus is in said extended orientation, thereby providing an area for said user to shower privately;

wherein said right vertical anchor member and said left vertical anchor member are removably attached thereto said wall surface by engaging a wall fastener means therethrough said plurality of right vertical anchor apertures and said plurality of left vertical anchor apertures, thereby providing a first stabilizing means for said apparatus in an extended orientation;

wherein said right horizontal anchor member and said left horizontal anchor member are removably attached thereto said ground surface by engaging a ground fastener means therethrough said plurality of right horizontal anchor apertures and said plurality of left horizontal anchor apertures, thereby providing a second stabilizing means for said apparatus in said extended orientation;

wherein said right door and said left door provide an entrance side for a user to enter said chamber when said apparatus is in said extended orientation;

wherein said apparatus is used with said wall surface containing a shower head and, wherein said right wall assembly and said left wall assembly collapse from said extended orientation to a retracted orientation, thereby allowing said apparatus to fold up when not in use;

gathering and identifying all parts of said apparatus;

locating a center point for said apparatus ordinarily therefrom a position of said shower head;

measuring and marking eighteen (18) inches outwardly to each side of said shower head;

lining said first left wall and said left vertical anchor member therewith previous markings;

vertically leveling said first left wall and said left vertical anchor member;

marking said left vertical anchor apertures thereon said wall surface and said left horizontal anchor apertures thereon said ground surface;

removing said first left wall and said left vertical anchor member therefrom said wall surface;

drilling mounting holes which correspond thereto said left vertical anchor apertures and said left horizontal anchor apertures marks;

mounting said left vertical anchor member and said left horizontal anchor member by inserting and tightening said wall fastener means therethrough said left vertical anchor apertures and therein said wall surface, said ground fastener means therethrough said left horizontal anchor apertures and therein said wall surface and said ground surface;

attaching said second left wall thereto said first left wall by lining up a hinge and inserting a hinge pin therein each of said hinges;

attaching said left door thereto said second left wall by lining up said hinges and inserting said hinge pins therein said hinges;

mounting said right vertical anchor member and said right horizontal anchor member by inserting and tightening said wall fastener means therethrough said right vertical anchor apertures and therein said wall surface, said ground fastener means therethrough said right horizontal anchor apertures and therein said wall surface and said ground surface;

attaching said second right wall thereto said first right wall by lining up said hinge and inserting said hinge pin therein each of said hinges;

attaching said right door thereto said second right wall by lining up said hinges and inserting said hinge pins therein said hinges;

attaching a header thereto said right header support member by lining up said hinge and inserting said hinge pin therein said hinge;

extending said left wall assembly and said right wall assembly to a fully extended position;

marking a location where a left wall pin and a right wall pin comes into contact with said ground surface;

placing said left wall assembly and said right wall assembly in a fully retracted orientation;

drilling a ground aperture therein said ground surface as marked;

fully extending said left wall assembly and said right wall assembly;

engaging a right wall pin and said left wall pin therein said ground apertures;

lifting said header and resting a free end thereon a saddle of said left header support member;

entering said chamber of said apparatus through said entrance side;

closing said left door and then said right door until a door lip is in contact with said left door;

latching said right door and said left door by engaging a hook affixed thereto said left door therein an eyelet affixed thereto said right door;

showering as normal;

unlatching and opening said right door and said left door;

exiting said apparatus;

lifting said header therefrom said saddle and placing said header in a hanging rest position;

disengaging said right wall pin and said left wall pin therefrom said ground apertures;

placing said left wall assembly in a fully retracted orientation;

placing said right assembly in a fully retracted orientation; and, benefiting from increased convenience, improved space utilization, and privacy afforded said user of said apparatus.

* * * * *